United States Patent [19]

Ward

[11] 4,234,649

[45] Nov. 18, 1980

[54] BINDER MATERIAL SEAM

[75] Inventor: Robert C. Ward, Bay Shore, N.Y.

[73] Assignee: Commercial Affiliates, Inc., New York, N.Y.

[21] Appl. No.: 688,943

[22] Filed: May 24, 1976

[51] Int. Cl.[2] ..... B32B 7/00

[52] U.S. Cl. ..... 428/255; 428/253; 428/256; 428/264; 428/265; 428/343; 428/344; 428/355; 428/914

[58] Field of Search ..... 428/247, 255, 253, 196, 428/198, 201, 245, 256, 202, 197, 343, 355, 109, 110, 111, 344, 914

[56] References Cited

U.S. PATENT DOCUMENTS

| | | | |
|---|---|---|---|
| 2,314,162 | 3/1943 | Reinhardt | 428/196 |
| 3,410,747 | 11/1968 | Orr | 428/255 |
| 3,485,704 | 12/1969 | Clymen | 428/109 |
| 3,755,058 | 8/1973 | Winkler | 428/196 |
| 3,877,959 | 4/1975 | Weiss | 428/156 |
| 3,972,768 | 8/1976 | Hill | 428/247 |
| 4,075,377 | 2/1978 | Aitchison et al. | 428/253 |

*Primary Examiner*—James J. Bell

*Attorney, Agent, or Firm*—Holland, Armstrong, Wilkie & Previto

[57] ABSTRACT

A binder material, such as a sheet or ribbon, including a grid construction of pressure sensitive adhesive for strippably adhering a work piece, such as carpeting, to a holding surface, such as a floor, and/or seaming the work pieces together over the holding surface, and a method for installing the work pieces over the tacky adhesive which comprises the positioning and partial removal of protective release coating between the work piece and the binder material during positioning.

20 Claims, 15 Drawing Figures

BINDER MATERIAL SEAM

BRIEF DESCRIPTION OF THE INVENTION

This invention relates to seaming work pieces together and, in particular, work pieces which are seamed together and held over a holding surface. An example of such an arrangement would be pieces of carpet which are seamed and held to a floor or material held to a wall or a ceiling.

In the usual prior art of adhering covering to surfaces and, in particular, floor coverings such as carpets to floor surfaces, the carpeting material would be cut to size, the seam areas would be located on the floor surface and a solvent type adhesive having the properties of becoming tacky and curing to a hard bond would be applied to the floor. The carpeting pieces would be placed over the adhesive and moved into proper position during the "open time" before the adhesive became too tacky to work. The adhesive would then be permitted to dry hard and adhere the carpeting in a fairly permanent bond to the floor.

Various methods were devised to provide for installations which could, nevertheless, be stripped from the floor without damaging a surface such as fine wood or tile. One solution of the prior art was to provide a double-faced adhesive tape which would adhere to the floor at one face and which would provide a second face for adhering the work pieces, or carpet pieces, to a seam line. The double-faced adhesive tape method has the disadvantage of failing to provide the operator or installer with a non-tacky surface on which to adjust the carpet seam, because the moment he places the carpeting on the pressure sensitive adhesive it will stick and it cannot be arranged by sliding such tacky adhesive surface to be abutted into a proper seam.

The present invention presents an improvement over the prior art in that it provides for a binder with a grid construction for reducing the total adhesive area contact with both the floor and the carpet work pieces. The binder material in either sheet or ribbon form is provided with pressure sensitive strippable adhesive which can be easily removed from the holding surface and permits the work pieces of carpeting to be adhered to make the proper seam adjustments and abutment by permitting easy lifting of the carpet from the binder during installation. The special improvements of this invention comprise a control grid construction for varying the contact area of the adhesive with the floor and carpeting as well as a release cover construction for the pressure sensitive adhesive which may be used during installation to keep portions of the carpet from contact with the adhesive, thereby simulating "open time" for positioning the pieces and abutting the seams.

Further objects and advantages will appear in the specification hereinbelow.

DESCRIPTION OF THE DRAWINGS

The invention is illustrated in the accompanying drawings, in which.

DETAILED DESCRIPTION OF THE INVENTION

The binder material of the invention is illustrated in its preferred form in FIGS. 1 through 4 of the drawings. While the invention may be used in various types of installation where it is desired to place a covering material over a surface construction such as a floor or wall, or the like, one of its principal uses is in the field of carpet laying and the invention will be described here in its preferred forms as a binder material useful in making carpet installation and seaming, it being understood that its construction and uses are not so limited.

For example, the work pieces 20, 22 and 24 described in the specification will be referred to as carpet or carpeting pieces and the holding surface 26 will be referred to as floor or floor surface. It will therefore be understood that the term carpet or carpeting not only includes carpeting pieces but any other work piece of any kind which may be installed within the scope and spirit of the invention and the term floor or floor surface will not only refer to a floor but a wall or any other type of holding surface construction on which the covering or work piece 20 may be installed.

Figure 3:
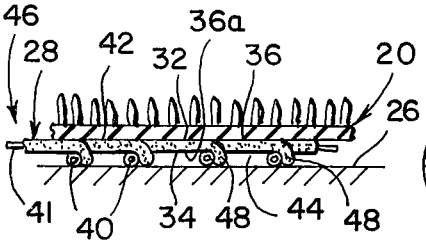
FIG. 3 is an elevational view similar to FIG. 1 with the protective cover removed and a carpet work piece 20 added.
Figure 4:
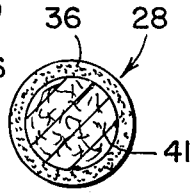
FIG. 4 is a sectional view somewhat enlarged of that portion of FIG. 2 taken on lines 4—4.

Carpet pieces 20, as shown in FIG. 3, and carpet pieces 22 and 24, as shown in FIGS. 8–15, are similar and represent work pieces in general.

Figure 1:
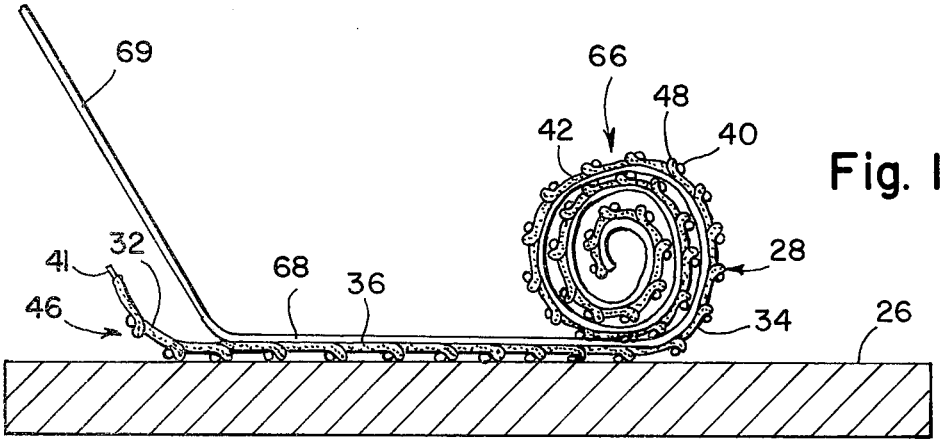
FIG. 1 is an elevational view partly in section.
Figure 2:
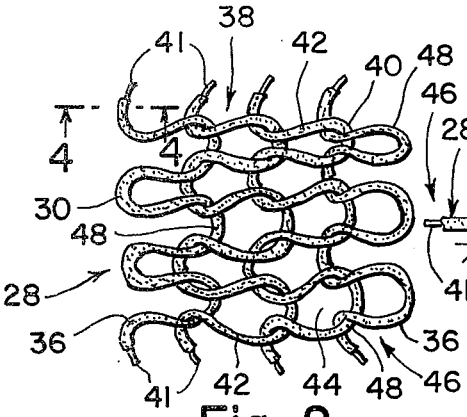
FIG. 2 is a top plan view.

The binder material 28 comprises a main body portion 30, usually in sheet form, or in ribbon form, as shown in FIG. 1. The main body portion has surface portions such as surface portions 32 and 34. It is conceivable that a binder material made in accordance with the invention may have more than two main surface portions. However, it will suffice for this specification to explain the construction with the binder material 28 of the preferred form which has two main surfaces 32 and 34.

The binder material comprises pressure sensitive adhesive means 36 which may be in the form of a coating which covers the entire binder material 28 or in any other form suitable for operation with the invention as described.

The body portion 28 is provided with a grid construction 38 which may be formed by a network including rib formations 40, or frame elements 42 surrounding interstices 44 with or without the rib formations 40. In the preferred form of the invention as illustrated in FIGS. 1 through 4, the binder material 28 is made of a loosely woven or knitted material 46 commonly known as "scrim". The portion of scrim 46 shown in FIG. 2 of the drawings illustrates the grid construction 38. It comprises a network of thread or yarn 41 which makes up the grid frame elements 42 surrounding the interstices 44. The thread or yarn 41 which may be woven or knitted may be made to form loops, bights or coils 48, or knots or other shapes to make rib formations 40, which, as can be seen in FIG. 3, extend outwardly from at least one surface 34 of the main body portion of the binder material 28 to form a ribbed configuration, or rib means 40, for the grid construction 38 for this form of the invention.

Ribs 40 extend outwardly from the surface 34 and if the surface 34 is laid against a floor, or holding surface, 26, the adhesive portions 36 around the ribs 40 will contact the floor 26 while the adhesive portions 36*a* between the ribs 40 will be spaced away from a surface of floor 26, as illustrated in FIG. 3. The ribs 40 provide a further control grid element which reduces the total contact area of the adhesive 36 of the binder material 28 to the floor 26 or, if desired, to a carpet piece 20, 22 or 24. Another way of reducing and controlling adhesive contact is by the provision of the interstices 44 between the frame elements 42.

The interstices 44 do not hold any adhesive 36. The adhesive 36 is only on the frame elements 42. The larger the interstices 44, the less adhesive contact between the binder material 28 and the floor 26, because there is less relative adhesive contact area to the total floor area covered by the binder material 28. Conversely, the smaller the interstice area 44, the greater the relative adhesive contact area provided by the frame element 42 within the total covered area. Another method of grid control would be to vary the diameter of the frame elements 42. The wider the frame elements, the more adhesive contact and, conversely, the narrower the frame elements, the less adhesive to contact the floor 26 for a given area.

When the ribs 40 of the scrim 46 are placed against a floor 26 the strippability of the scrim 46 is enhanced by the ribs 40 extending from surface 34 to reduce total adhesive contact with the floor 26. This further reduces the possibility of leaving any residue on the floor 26 when it is desired to strip the carpet 20 and the scrim 46. Surface 32 of the scrim 46 does not have rib means 40. It presents a greater adhesive area to the surface of carpeting piece 20 which is pressed against it as shown in FIG. 3. The scrim 46 thus has a greater degree of adherence to the carpet 20 than to the floor 26. The scrim 46 also reinforces the carpet backing during removal. When they are peeled from the floor they will release cleanly.

Scrim material 46 may be woven, knitted or molded out of plastic, threads or yarns or filaments to provide for ribbing 40 on either or both sides 32 and 34 or to provide for both sides (32, 34) to be smooth.

Figure 5:
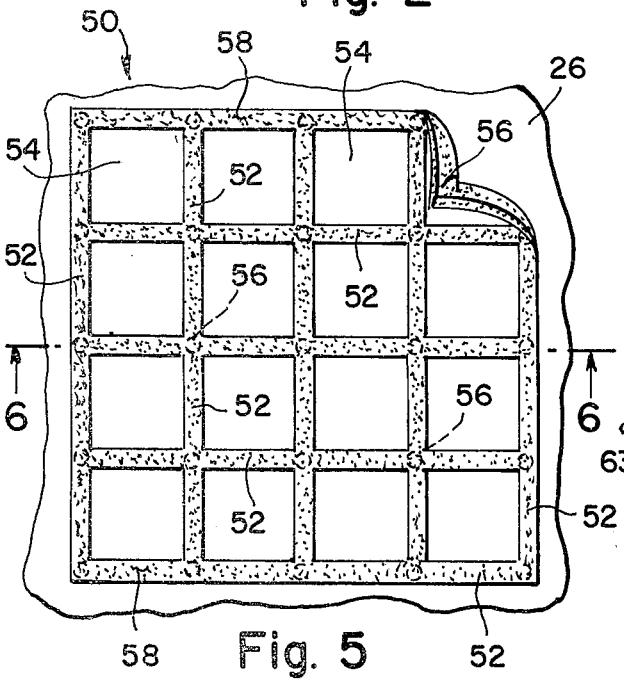
FIG. 5 is a top plan view of another form of the invention.

A binder material with grid control can be provided in another form of invention as illustrated in FIG. 5. In the form of invention shown in FIG. 5, the binder material 50 is made in a grid formation out of a synthetic material such as plastic provided with frame elements 52 and interstices 54 which may be formed by any suitable method of the plastic arts.

The binder material 50 is coated with pressure sensitive adhesive 58. The interstices 54 in this form of the invention, as well as in any other form which the invention may take, can be either circular or square or any geometric formation so long as they provide open space between the frame elements of the invention so that the area of adhesive exposure can be controlled by the designed grid formation of the invention.

Figure 6:
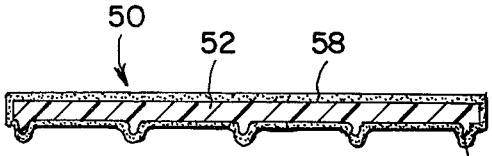
FIG. 6 is a sectional view along lines 6—6 of FIG. 5.

Binder material 50 may be made without rib formations with both surfaces plain, or, as shown in FIG. 6, rib element 56 may be formed into at least one side of an alternate form of invention for further adhesive contact control. Ribs 56 may also be placed on both sides, is desired.

Figure 7:
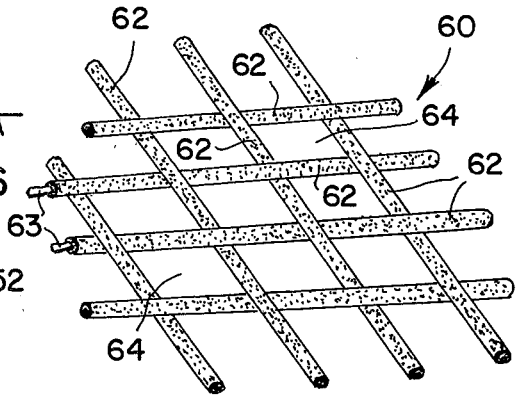
FIG. 7 is a perspective view of another form of the invention.

The grid or network formation may also be comprised in a mesh formation 60 which may be made of wire or any other suitable filament material. In the form shown in FIG. 7 of the drawings the frame elements 62 comprise wire filaments 63 which surround the interstices 64. The simple mesh network of the binder material 60 is achieved by alternating the weave of the frame element 62. This would provide a binder material 60 which may be made substantially flat on both sides without ribbed formation or ribs may be supplied as desired.

The exposed surfaces of all of the filaments 63 are covered with pressure sensitive adhesive. The binder material 60 provides a grid control which can be varied by spacing the frame elements 62 to provide for a coarser or finer weave. The coarser the weave, the greater the size of the interstices 64 and the less adhesive contact per given area with a floor 26 or a carpet piece 20.

It is desirable to have a binder material flexible enough to be rolled into a roll 66, as shown in FIG. 1, which comprises a ribbon of binder material scrim 46 and a protective release covering 68 for the adhesive 36.

The adhesive 36 should have the property in dry form (solvent or water free) of being aggressively and permanently tacky and to firmly adhere to a variety of dissimilar surfaces upon contact. The pressure sensitive adhesive 36 does not require activation by water, solvent or heat in order to exert a strong adhesive holding force toward such materials as the floor covering (such as a carpet) or the floor itself, which may be made of wood, concrete, terrazzo, or similar construction material, as well as existing floor coverings (for example, linoleum, tile, or the like). The pressure sensitive adhesive 36 should have a sufficiently cohesive holding and elastic nature so that despite its aggressive tackiness which gives it the properties of adhering with tenacity to most surfaces and resisting displacement, it may yet be removed by lifting or stripping force sufficient to lift pressure sensitive adhesive, leaving the floor clean of adhesive and without a residue. The term pressure sensitive as used herein does not include adhesives which are merely sticky, for example flypaper adhesives, or merely because adhesives adhere to a special type of surface, as in self sealing envelopes.

The preferred adhesive 36 is a non-oxidizing pressure sensitive adhesive comprising permanently tacky modified acrylic vinyl acetate-ethelyne copolymer material.

The frame elements 42 of the invention may comprise filament construction, or any other type of fabrication which will produce a suitable body portion for the binder material. The term "filament" as used herein is defined to include thread, or yarn-like, components of natural or synthetic content and includes filaments of metal, such as wire. Filaments may be woven into a scrim type 46 material or such scrim material may be fashioned out of molded or extruded plastic in a manner to simulate a woven filament construction. Filaments may also be made of paper material such as kraft paper cord.

Frame elements 52 of the invention may also be molded as a grid (as shown in FIGS. 5 and 6) in forms different from the scrim 46 type fabrication.

The term "woven" as used herein is defined to include all types of woven, netted, meshed, knitted, knotted or other fabrication of natural or synthetic filaments, such as yarn, or thread which may be used to make a binder material of the invention.

The term "rib" or "ribbed" or "rib means" or "rib formations", as used herein, refers to extensions from the surface of a binder material and includes formations such as legs, feet, pedestals, or support structures, as well as the woven type ribs 40 of the scrim 46, extending from a surface of the binder material, which serve to space at least part of the adhesive portions of the binder material away from the holding surface 26 or work piece 20, as the case may be, to reduce adhesive contact for a given area.

INSTALLATION AND SEAM CONSTRUCTION

The following description of the installation and seam construction applies to all types of binder material of the invention. it is preferred to use rolls 66, rolled up with a protective cover 68, but precut sheets of binder material of the invention having a protective cover similar to cover 68 may also be used. For purposes of clarity a reference will be made only to the scrim type 46 binder material shown in FIGS. 1 through 4. The same procedures can be used with all binder material within the scope of the invention.

A roll 66 of scrim 46 provided with a strip of protective covering release material 68 may be used to bind and seam carpet pieces 22 and 24 to a floor 26. The release cover has a leader 69 long enough to cover the circumference of the roll 66 when completely rolled prior to use. Such carpet pieces 22 and 24 may have been in the form of rolls which are 9, 12 and 15 feet wide or in narrower 27 to 54 inch widths. The carpeting 22 and 24 is cut to proper length to fit the floor area 26 in edge to edge abutment.

Figure 8:
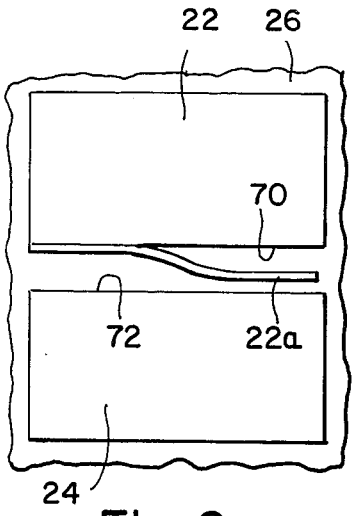
FIGS. 8 through 15, inclusive, are top plan diagrammatic views of various steps in the installation of work pieces with some parts in phantom and some parts cut away.

A preliminary step is illustrated in FIG. 8 of the drawings where a pair of adjoining carpeting pieces 22 and 24 were measured, cut to size and trimmed, if necessary, and then aligned on a floor 26. Carpet piece 22 may have had strip 22*a* trimmed away for a proper fitting and remaining edge 70 is provided for abutment against edge 72 of carpet piece 24.

Figure 9:
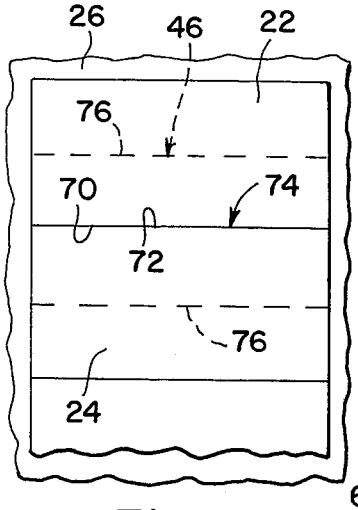
Figure 12:
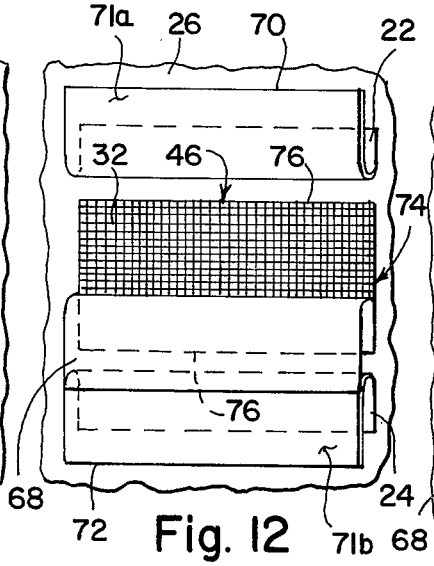
Figure 10:
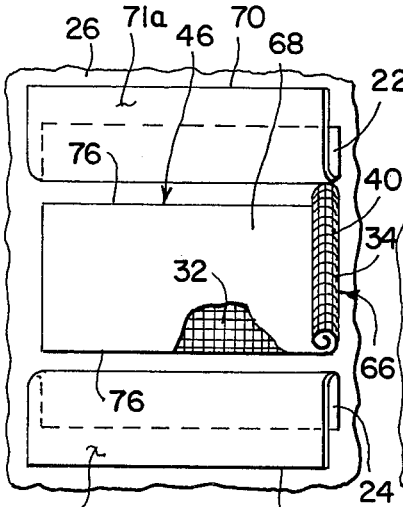

In FIGS. 9 and 10 of the drawings the steps of aligning strips of covered scrim 46 in an offset relationship to the intended positioning of the carpet pieces 22 and 24 are shown. Each strip of scrim 46 is provided with its section of release cover 68. The solid line 74 indicates the abutment of the carpeting edges and the dotted lines 76 indicate the edges of the scrim 46.

The carpeting having been cut is laid in offset relationship over the covered scrim 46 so that a carpeting seam line 74 runs along the median of the scrim 46.

Reference to FIG. 10 shows a roll 66 of scrim 46 being applied to a floor 26 between two folded over carpet pieces 22 and 24. It is the choice of the installer to arrange the carpeting pieces and then put the scrim down or reverse this procedure as he wishes.

Figure 11:
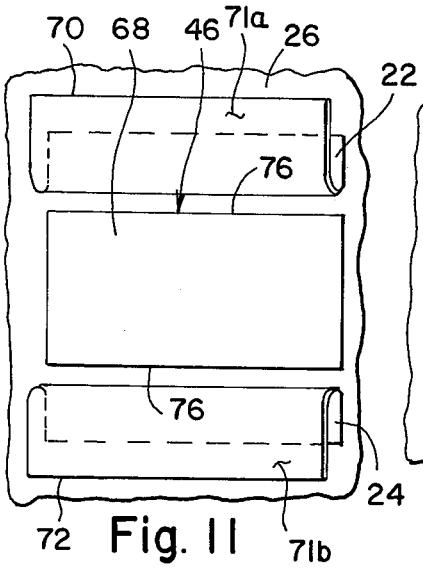

In any event the scrim is unrolled with its ribbed configuration 40 on surface 34 facing the floor 26 and its unribbed surface 32 facing away from the floor 26 and toward the bottoms 71*a* and 71*b* of carpeting pieces 22 and 24. The protective covering 68 remains in position. The scrim 46 is cut from the roll to complete a strip for this portion of the installation. After positioning the scrim 46 and the folded carpet pieces 22 and 24, as shown in FIG. 11, the next step is to start to remove the protective liner 68 from the upper surface 32 of the scrim 46 to a point somewhat below the seam line 74 which is designated by the arrow in FIG. 12.

Figure 14:
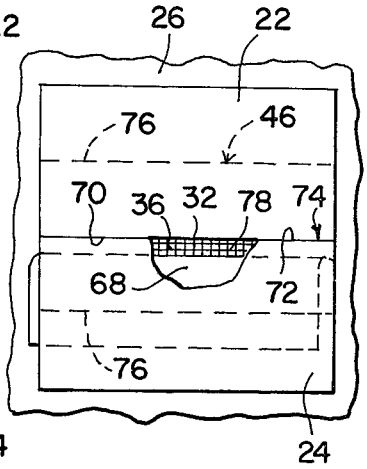
Figure 13:
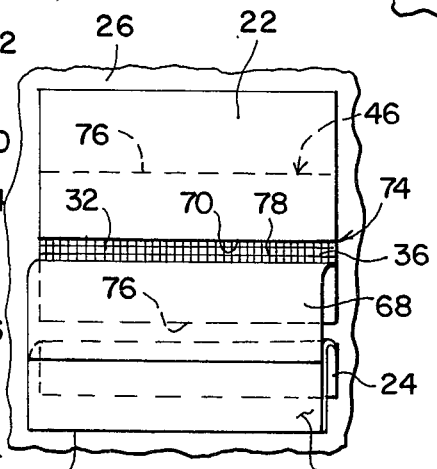

The next step is illustrated in FIG. 13. Carpet piece 22 has been placed over uncovered surface 32 of the scrim 46 and adhered to it with its edge 70 along seam line 74. FIGS. 13 and 14 illustrate the intermediate steps of the process of the invention which, in addition to the workability of the scrim grid construction for permitting the repeated adhesion and lifting of the carpet edges 70 and 72 during seam placement, also employ the cover material 68 to provide a substitute for the "open time" associated with direct application of a flowable cement prior to curing. The carpet pieces 22 and 24 will easily slide over the release covering 68 during these steps.

In FIG. 13 one carpet piece 22 has been adhered to the scrim 46 with its edge 70 along seam line 74 and the second carpet piece 24 still has its seam edge 72 folded back. The release coating 68 over scrim 46 has been removed to below the line 74 but has been left on substantially all of the adhesive 36 of scrim 46 below seam line 74 with the exception of a small portion 78 of adhesive 36 left exposed below seam line 74.

Figure 15:
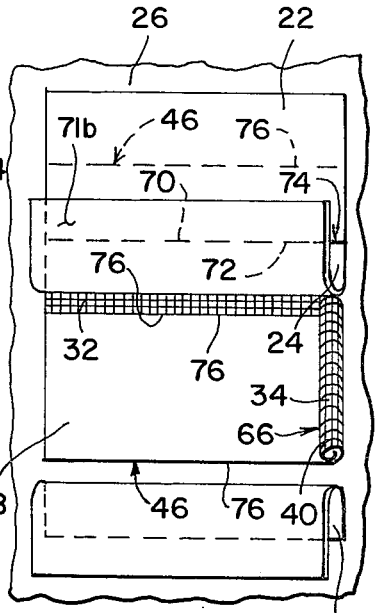

Reference is now made to FIG. 14 where edge 72 of carpet piece 24 has been brought up by the operator to abut edge 70 of carpet piece 22 over exposed portion 78 of scrim 46. The operator may place edge 72 down and apply it to the adhesive 36 in exposed portion 78 and lift it and reapply it (as in FIG. 14) as often as needed to make a proper seam fit along line 74. While the operator is doing this the rest of carpet piece 24 will slide easily over the release cover material 68 which remains folded above the scrim material 46 below seam line 74 and underneath carpet piece 24 in all places except the exposed area 78. Thus the operator can work the seam along line 74 until it is fitted, without being hampered by the bottom surface 71*b* of the carpet piece 24 adhering to the adhesive 36 of scrim strip 46. This provides the equivalent of "open time" in this type of installation. Succeeding carpet pieces, such as piece 80, are installed to the floor 26 with succeeding sections of scrim 46 in the manner described hereinabove for pieces 22 and 24 (as shown in FIG. 15).

Carpet may also be supplied in squares or other shapes to be installed individually like tile. Such pieces may be installed directly over a layer of binder material of the invention.

It may be desirable with some carpet, such as a rubber back carpet, to treat the bottom of the rubber backing with a sealer in order to give it strength to be adhesively secured and to release and rebond to the binder material. It is also desirable in some constructions, especially a floor 26 with a rough concrete surface, to provide a sealer for the floor construction. it is not necessary to provide a sealer in all cases for either the carpet or the floor and this is done only when deemed desirable.

In preparing the binder material 28 for installation of work pieces, the extent of the total area of the grid formed surface area of the adhesive presented to either the holding surface or the work piece may be varied in construction of the binder material 28 according to a ratio between said grid formed surface area and the total area of either work piece or holding surface covered with relationship to the outside dimensions of the binder material 28. For example, a piece of binder material 4 feet by 10 feet would be associated with either a holding surface or a work piece or pieces of 40 square feet. Within this 40 square foot area of holding surface covered by binder material 28 there would be much less than 40 square feet of actual contact area between the holding surface and the adhesive of the binder material 28, 46 or 50.

A clearer example can be given in the case of binder material 50, as illustrated in FIG. 5 of the drawings. Let us assume that the width of the grid frames 52 can be arranged in accordance with the ratio between the area of the adhesive on a surface formed by the grid frames as computed to the total area covered by the entire binder material 50. Varying the width of each frame element 52 will vary the ratio of adhesive contact of the adhesive surface area to the entire area covered by the entire binder material 52. This provides a control which may be incorporated into a method of installation by preparing a binder material of the invention with adhesive contact areas in different ratios to the total area covered by the binder material to provide for greater or lesser degrees of adhesion to a holding surface or a work piece. The employment of the ribs of the invention will reduce this area and increase the size of the ratio between adhesive contact surface and total area.

The foregoing example illustrates one of many methods of use of the invention. For example, scrim 46 (or other material of the invention) may be provided with rib formations 40 (or 56) on either or both surfaces, or none, as desired. Work pieces may include many other coverings in addition to carpeting. A few examples are floor tiles of vinyl, cork, ceramic or other materials, and upholstery and drapery material, as well as wall coverings to mention a few.

While I have described my invention in its preferred forms, there are other forms which it may take within the spirit and scope of the claims hereinbelow.

Wherefore, I claim:

1. Binder material comprising a grid-like frame construction for stripably binding covering material to rigid holding surface, said binder material comprising a first outer surface and a second outer surface, said first outer surface being next to said holding surface, said binder material comprising a plurality of spaced frame elements intersecting each other to form a grid-like frame construction, said frame elements being coated with pressure sensitive adhesive, said adhesive coating being present only on said frame elements, said adhesive on said frame elements being positioned on said first outer surface which is next to said holding surface and on said second outer surface, and the pressure sensitive adhesive comprises the property of being strippable from both the holding surface and the covering material.

2. Binder material as claimed in claim 1, in which the adhesive is a non-oxidizing pressure sensitive adhesive comprising permanently tacky modified acrylic vinyl acetate-ethelyne copolymer material.

3. Binder material as claimed in claim 1, in sheet form, together with at least one release cover.

4. Binder material as claimed in claim 1 rolled in ribbon form, together with at least one release cover.

5. Binder material as claimed in claim 1, in which a binder material outer surface comprises rib means.

6. Binder material as claimed in claim 1, in which both said binder material outer surfaces comprises rib means.

7. Binder material as claimed in claim 1, in which the binder material is in ribbon form and the first and second outer surfaces are the broader sides of the ribbon.

8. Binder material as claimed in claim 1, in which the frame elements are comprised in a loosely woven construction comprising at least one filament.

9. Binder material as claimed in claim 8, in which the filament comprises at least one natural material.

10. Binder material as claimed in claim 8, in which the filament comprises paper.

11. Binder material as claimed in claim 8, in which the filament comprises metal.

12. Binder material as claimed in claim 8, in which the filament comprise woven wire.

13. Binder material as claimed in claim 8, in which the frame elements comprise at least one plastic material.

14. Binder material as claimed in claim 1, in which the construction is comprised in a loosely woven scrim type material.

15. Binder material as claimed in claim 1 which comprises at least one adhesively coated rib formation.

16. Binder material as claimed in claim 1, in combination with a release cover for at least one surface portion thereof.

17. Binder material as claimed in claim 1, in combination with at least one work piece such as a covering material and at least one holding surface to form a strippable surface covering for the holding surface.

18. Binder material as claimed in claim 1, in which the degree of adhesion of the work piece to the binder material is greater than that of the binder material to the holding surface.

19. Binder material as claimed in claim 1, in which the adhesive means substantially surrounds the frame elements but does not fill the spaces therebetween.

20. Binder material as claimed in claim 1 in which the frame elements and the spaces therebetween are selectively proportioned to vary the area of the adhesively coated frame elements at an outer surface area with relation to the area of the spaces therebetween which are free of adhesive.

* * * * *